US008698700B2

(12) United States Patent
Pathak et al.

(10) Patent No.: US 8,698,700 B2
(45) Date of Patent: Apr. 15, 2014

(54) METAMATERIAL ANTENNA WITH MECHANICAL CONNECTION

(75) Inventors: Vaneet Pathak, San Diego, CA (US); Ajay Gummalla, San Diego, CA (US)

(73) Assignee: Tyco Electronics Services GmbH (CH)

( * ) Notice: Subject to any disclaimer, the term of this patent is extended or adjusted under 35 U.S.C. 154(b) by 598 days.

(21) Appl. No.: 12/604,306

(22) Filed: Oct. 22, 2009

(65) Prior Publication Data

US 2011/0095964 A1 Apr. 28, 2011

(51) Int. Cl.

| | |
|---|---|
| ***H01Q 15/02*** | (2006.01) |
| ***H01Q 1/50*** | (2006.01) |
| ***H01Q 1/24*** | (2006.01) |
| ***H01Q 1/38*** | (2006.01) |

(52) U.S. Cl.
USPC ..... 343/909; 343/700 MS; 343/702; 343/906

(58) Field of Classification Search
USPC ..... 343/702, 909, 906
See application file for complete search history.

(56) References Cited

U.S. PATENT DOCUMENTS

| | | | | |
|---|---|---|---|---|
| 7,592,957 | B2 | 9/2009 | Achour et al. | |
| 2003/0063032 | A1 * | 4/2003 | Usui et al. | 343/700 MS |
| 2005/0151698 | A1 | 7/2005 | Mohamadi | |
| 2007/0176827 | A1 * | 8/2007 | Itoh et al. | 343/700 MS |
| 2008/0258981 | A1 | 10/2008 | Achour et al. | |
| 2008/0303743 | A1 * | 12/2008 | Park et al. | 343/895 |
| 2009/0128446 | A1 | 5/2009 | Gummalla et al. | |
| 2009/0135087 | A1 | 5/2009 | Gummalla et al. | |
| 2009/0295660 | A1 | 12/2009 | Xu et al. | |
| 2010/0013714 | A1 | 1/2010 | Azhari | |
| 2010/0225554 | A1 | 9/2010 | Huang et al. | |
| 2011/0273348 | A1 | 11/2011 | Lopez et al. | |

FOREIGN PATENT DOCUMENTS

| | | | |
|---|---|---|---|
| CN | 1624977 | A | 6/2005 |
| CN | 1945898 | A | 4/2007 |
| CN | 202159758 | U | 3/2012 |
| JP | 10084216 | | 3/1998 |
| JP | 2005244452 | | 9/2005 |
| KR | 20080017857 | A1 | 2/2008 |
| WO | WO-2006051257 | A1 | 5/2006 |
| WO | WO-2009049303 | A1 | 4/2009 |
| WO | WO-2011049584 | A1 | 4/2011 |

OTHER PUBLICATIONS

"Chinese Application Serial No. 201020579435.3, Office Action mailed Jan. 26, 2011", 2 pgs.
"International Application Serial No. PCT/US2009/061945, International Search Report and Written Opinion mailed Nov. 26, 2010", 9 pgs.
Caloz, C., et al., Electromagnetic Metamaterials: Transmission Line Theory and Microwave Applications, John Wiley & Sons (2006).
Itoh, T., "Invited Paper: Prospects for Metamaterials," Electronics Letters, 40(16):972-973, Aug. 2004.
"Chinese Application Serial No. 201020579435.3, Office Action mailed Jul. 8, 2011", 2 pgs.

(Continued)

*Primary Examiner* — Douglas W Owens
*Assistant Examiner* — Jennifer F Hu

(57) ABSTRACT

Metamaterial antenna devices having one or more mechanical connection units made of electrically conductive materials to provide both mechanical engagement and electrical conduction for the antenna devices.

22 Claims, 6 Drawing Sheets

(56) References Cited

OTHER PUBLICATIONS

"International Application Serial No. PCT/US2009/061945/ International Preliminary Report on Patentability mailed May 3, 2012", 6 pgs.
U.S. Appl. No. 13/083,081, Non Final Office Action mailed May 23, 2013, 9 pgs.
Chinese Application Serial No. 201010521852.7, Office Action mailed Mar. 5, 2013 (with English translation), 11 pgs.
U.S. Appl. No. 13/083,081, Response filed Sep. 23, 2013 to Non-Final Office Action mailed May 23, 2013, 10 pgs.
"Chinese Application Serial No. 201010521852.7, Office Action mailed Dec. 18, 2013", (With English Translation), 6 pgs.
"Korean Application Serial No. 10-2012-7013056, Office Action mailed Dec. 18, 2013", (With English Translation), 9 pgs.

* cited by examiner

METAMATERIAL ANTENNA WITH MECHANICAL CONNECTION

BACKGROUND

This document relates to metamaterial antenna structures.

The propagation of electromagnetic waves in most materials obeys the right-hand rule for the (E,H,β) vector fields, where E is the electrical field, H is the magnetic field, and β is the wave vector (or propagation constant). The phase velocity direction is the same as the direction of the signal energy propagation (group velocity) and the refractive index is a positive number. Such materials are "right handed (RH)" materials. Most natural materials are RH materials. Artificial materials can also be RH materials.

A metamaterial (MTM) has an artificial structure. When designed with a structural average unit cell size ρ much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation where the relative directions of the (E,H,β) vector fields follow the left-hand rule. Metamaterials that support only a negative index of refraction with permittivity ∈ and permeability μ being simultaneously negative are pure "left handed (LH)" metamaterials. Many metamaterials are mixtures of LH metamaterials and RH materials and thus are Composite Right and Left Handed (CRLH) metamaterials. A CRLH metamaterial can behave like a LH metamaterial at low frequencies and a RH material at high frequencies.

Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004). CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This document discloses examples of metamaterial antenna devices having one or more mechanical connection units made of electrically conductive materials to provide both mechanical engagement and electrical conduction for the antenna devices.

In one aspect, a metamaterial antenna device is provided to include a substrate structure; one or more metallization layers supported by the substrate structure and structured to include a ground electrode which is formed in one of the one or more metallization layers, and electrically conductive parts formed in at least one of the one or more metallization layers; and one or more connecting units. Each connecting unit mechanically engages parts of the substrate structure or the substrate structure to a device enclosure and electrically coupled to at least one of the plurality of electrically conductive parts. The electrically conductive parts, the one or more connecting units, and at least part of the substrate structure are configured to form a composite left and right handed (CRLH) metamaterial antenna structure that exhibits a plurality of frequency resonances associated with an antenna signal.

In another aspect, a metamaterial antenna device is provided to include a device enclosure; a substrate structure residing inside the device enclosure; a ground electrode supported by the substrate structure; electrically conductive parts supported by the substrate structure; and a mechanical connector, made of an electrically conductive material, mechanically engaging the substrate structure to the device enclosure and electrically coupled to at least one of the plurality of electrically conductive parts. The mechanical connector, the ground electrode, at least part of the substrate structure and the electrically conductive parts are configured to form a composite left and right handed (CRLH) metamaterial antenna structure that exhibits one or more frequency resonances associated with an antenna signal.

These and other aspects, and their implementations and variations are described in detail in the attached drawings, the detailed description and the claims.

DETAILED DESCRIPTION

Figure 1A:
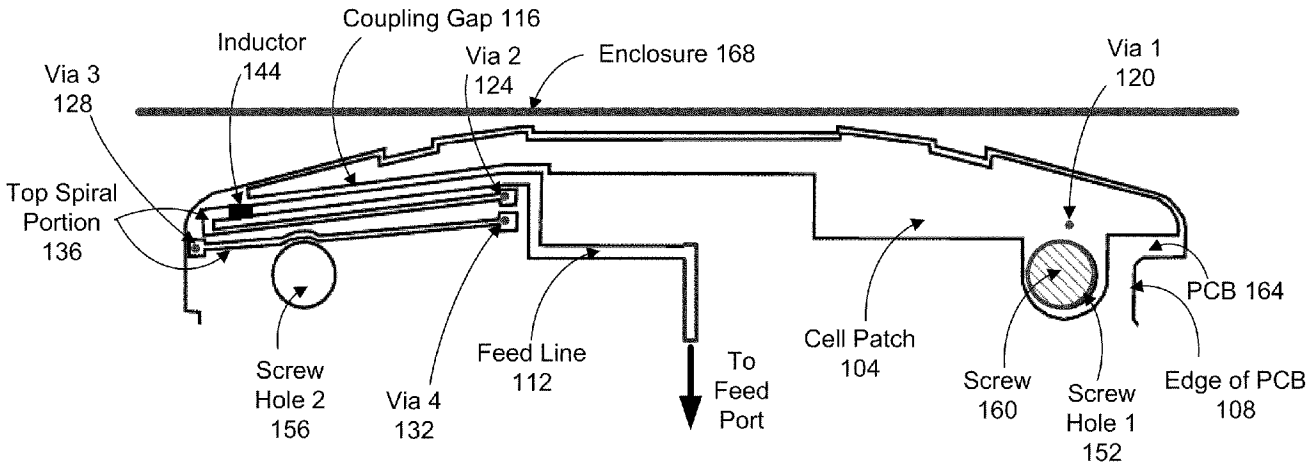
FIGS. 1A and 1B show an example of a double-layer MTM antenna structure, illustrating the top view of the top layer and the top view of the bottom layer, respectively.

Metamaterial (MTM) structures can be used to construct antennas, transmission lines and other RF components and devices, allowing for a wide range of technology advancements such as functionality enhancements, size reduction and performance improvements. An MTM structure has one or more MTM unit cells. The equivalent circuit for an MTM unit cell includes a right-handed series inductance LR, a right-handed shunt capacitance CR, a left-handed series capacitance CL, and a left-handed shunt inductance LL. The MTM-based components and devices can be designed based on these CRLH MTM unit cells that can be implemented by using distributed circuit elements, lumped circuit elements or a combination of both. Unlike conventional antennas, the MTM antenna resonances are affected by the presence of the left-handed (LH) mode. In general, the LH mode helps excite and better match the low frequency resonances as well as improves the matching of high frequency resonances. The MTM antenna structures can be configured to support one or more frequency bands and a supported frequency band can include one or more antenna frequency resonances. For example, MTM antenna structures can be structured to support multiple frequency bands including a "low band" and a "high band." The low band includes at least one LH mode resonance and the high band includes at least one right-handed (RH) mode resonance associated with the antenna signal.

Some examples and implementations of MTM antenna structures are described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. The disclosures of the above US patent documents are incorporated herein by reference. These MTM antenna structures can be fabricated by using a conventional FR-4 Printed Circuit Board (PCB) or a Flexible Printed Circuit (FPC) board. Examples of other fabrication techniques include thin film fabrication technique, system on chip (SOC) technique, low temperature co-fired ceramic (LTCC) technique, and monolithic microwave integrated circuit (MMIC) technique.

One type of MTM antenna structures is a Single-Layer Metallization (SLM) MTM antenna structure, which has conductive parts of the MTM structure in a single metallization layer formed on one side of a substrate. A Two-Layer Metallization Via-Less (TLM-VL) MTM antenna structure is of another type characterized by two metallization layers on two parallel surfaces of a substrate without having a conductive via to connect one conductive part in one metallization layer to another conductive part in the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008, the disclosure of which is incorporated herein by reference.

In one implementation, a SLM MTM structure includes a substrate having a first substrate surface and an opposite substrate surface, a metallization layer formed on the first substrate surface and patterned to have two or more conductive parts to form the SLM MTM structure without a conductive via penetrating the dielectric substrate. The conductive parts in the metallization layer include a cell patch of the SLM MTM structure, a ground that is spatially separated from the cell patch, a via line that interconnects the ground and the cell patch, and a feed line that is capacitively coupled to the cell patch without being directly in contact with the cell patch. The LH series capacitance CL is generated by the capacitive coupling through the gap between the feed line and the cell patch. The RH series inductance LR is mainly generated in the feed line and the cell patch. There is no dielectric material vertically sandwiched between two conductive parts in this SLM MTM structure. As a result, the RH shunt capacitance CR of the SLM MTM structure can be made negligibly small by design. A relatively small RH shunt capacitance CR may be induced between the cell patch and the ground, both of which are in the single metallization layer. The LH shunt inductance LL in the SLM MTM structure may be negligible due to the absence of the via penetrating the substrate, but the via line connected to the ground may effectuate an inductance equivalent to the LH shunt inductance LL. An exemplary TLM-VL MTM antenna structure can have the feed line and the cell patch in two different layers to generate vertical capacitive coupling.

Different from the SLM and TLM-VL MTM antenna structures, a multilayer MTM antenna structure has conductive parts in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008, the disclosure of which is incorporated herein by reference. These multiple metallization layers are patterned to have multiple conductive parts based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures can have at least one conductive via to connect one conductive part in one metallization layer to another conductive part in another metallization layer.

An exemplary implementation of a double-layer MTM antenna structure with a via includes a substrate having a first substrate surface and a second substrate surface opposite to the first surface, a first metallization layer formed on the first substrate surface, and a second metallization layer formed on the second substrate surface, where the two metallization layers are patterned to have two or more conductive parts with at least one conductive via penetrating through the substrate to connect one conductive part in the first metallization layer to another conductive part in the second metallization layer. A truncated ground can be formed in the first metallization layer, leaving part of the surface exposed. The conductive parts in the second metallization layer can include a cell patch of the MTM structure and a feed line, the distal end of which is located close to and capacitively coupled to the cell patch to transmit an antenna signal to and from the cell patch. The cell patch is formed in parallel with at least a portion of the exposed surface. The conductive parts in the first metallization layer include a via line that connects the truncated ground in the first metallization layer and the cell patch in the second metallization layer through a via formed in the substrate. The LH series capacitance CL is generated by the capacitive coupling through the gap between the feed line and the cell patch. The RH series inductance LR is mainly generated in the feed line and the cell patch. The LH shunt inductance LL is mainly induced by the via and the via line. The RH shunt capacitance CR may be primarily contributed by a capacitance between the cell patch in the second metallization layer and a portion of the via line in the footprint of the cell patch projected onto the first metallization layer. An additional conductive line, such as a meander line, can be attached to the feed line to induce an RH monopole resonance to support a broadband or multiband antenna operation.

Examples of various frequency bands that can be supported by MTM antennas include frequency bands for cell phone and mobile device applications, WiFi applications, WiMax applications and other wireless communication applications. Examples of the frequency bands for cell phone and mobile device applications are: the cellular band (824-960 MHz) which includes two bands, CDMA (824-894 MHz) and GSM (880-960 MHz) bands; and the PCS/DCS band (1710-2170 MHz) which includes three bands, DCS (1710-1880 MHz), PCS (1850-1990 MHz) and AWS/WCDMA (2110-2170 MHz) bands.

An MTM structure can be specifically tailored to comply with requirements of a particular application, such as PCB real-estate factors, device performance requirements and other specifications. The cell patch in the MTM structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the capacitive coupling. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, planar spiral, vertical spiral, meander, or combinations of different shapes. The additional conductive line can be placed in the top, mid or bottom layer, or a few millimeters above the substrate. In addition, non-planar (three-dimensional) MTM antenna structures can be realized based on a multi-substrate structure. The examples and implementations of such multi-substrate-based MTM structures are described in the U.S. patent application Ser. No. 12/465,571 entitled "Non-Planar Metamaterial Antenna Structures," filed on May 13, 2009, the disclosure of which is incorporated herein by reference.

Antenna efficiency is one of the important performance metrics especially for a compact mobile communication device where the PCB real-estate is limited. In some antenna device designs, the decrease in the antenna size can cause the efficiency to decrease. In such designs, obtaining a high efficiency with a given limited space can pose a challenge in antenna designs especially for applications in cell phones and other compact mobile communication devices.

This document describes MTM antenna designs that use electrically conductive mechanical parts to provide both (1) mechanical connection, anchoring or support and (2) desired electrical conductive path and connection for the MTM antenna elements. The multiple functions of such an electrically conductive mechanical part allows for increase in the effective antenna size within a limited permissible space and can be beneficial to compact devices. In the examples of MTM antennas described in this document, a metal screw is used as a simple example of a conductive mechanical connection unit in an MTM antenna to provide not only a mechanical connection but also a conductive extension. In some implementations, such a conductive mechanical connection unit can effectively increase the area and volume of the MTM antenna, thereby improving the antenna efficiency without increasing the occupied space. The mechanical connection unit may be designed and positioned to modify the current distribution associated with the MTM antenna in the direction vertical to the printed antenna surface, for example. The radiation patterns and polarizations can thus be adjusted by changing the location and/or dimensions of the mechanical connection unit. Engaging such a mechanical connection unit with an MTM antenna structure can also facilitate the frequency tuning and impedance matching. Examples of mechanical connection units include fasteners such as screws, anchors, pins, nails, clips, spacers and standoffs, rods and studs, and inserts, which can be used in combination with screw bosses, nuts, washers, rings, etc.

Figure 1B:
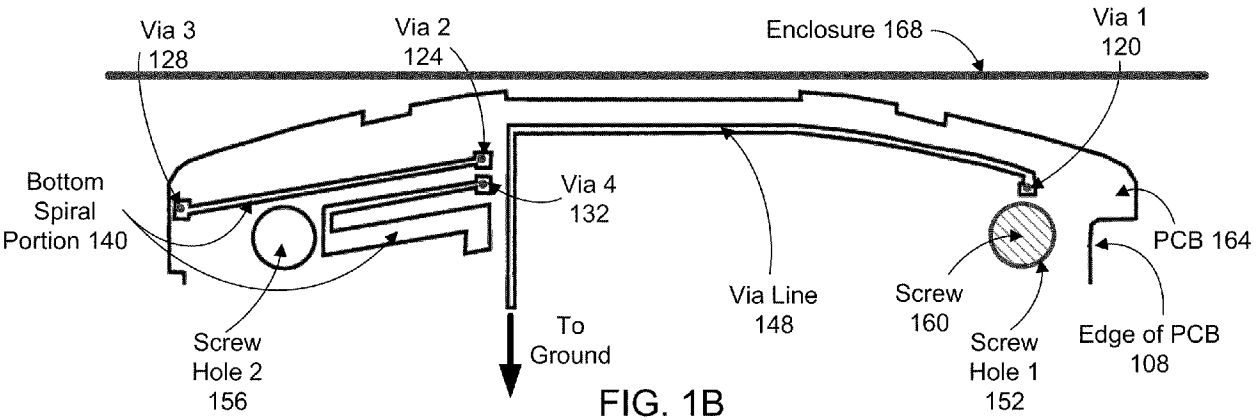

FIGS. 1A and 1B show an example of a double-layer MTM antenna structure printed on a PCB, illustrating the top view of the top layer and the top view of the bottom layer, respectively. A cell patch 104 is formed in the top layer. In order to maximize the cell patch area, the outer portion of the outline of the cell patch 104 is shaped to closely follow the edge of the PCB 108 in this example. A feed line 112 is formed in the top layer. The proximal end of the feed line 112 is coupled to a feed port through a coplanar waveguide (CPW) feed line, for example, which is in communication with an antenna circuit that generates and supplies an antenna signal to be transmitted out through the antenna, or receives and processes an antenna signal received through the antenna. The distal end of the feed line 112 is capacitively coupled to the cell patch 104 through a coupling gap 116 to direct the antenna signal to and from the cell patch 104. Via 1 (120), via 2 (124), via 3 (128) and via 4 (132) are inserted in the respective via holes so as to provide conductive connections between the conductive parts in the top layer and those in the bottom layer. In this example, a conductive spiral is attached to the feed line 112. The conductive spiral includes a top spiral portion 136, a bottom spiral portion 140, and the vias penetrating through the PCB. The top spiral portion 136 is comprised of discrete segments formed in the top layer; the bottom spiral portion 140 is comprised of another set of discrete segments formed in the bottom layer; and the via 2 (124), via 3 (128) and via 4 (132) are used to connect the top and bottom discrete segments to form a vertical spiral shape. An additional conductive line attached to the feed line 112 can induce an RH monopole resonance. Instead of the vertical spiral as used in this example, a meander line, a zigzag line or other type of lines or strips can be used. A lumped inductor 144 is used to connect the feed line 112 and the vertical spiral for space saving as shown in FIG. 1A. Alternatively, the feed line 112 and the spiral can be connected directly but with a different total length. A via line 148 is formed in the bottom layer and coupled to the ground. The via 1 (120) connects the cell patch 104 in the top layer to the via line 148 in the bottom layer.

Figure 1C:
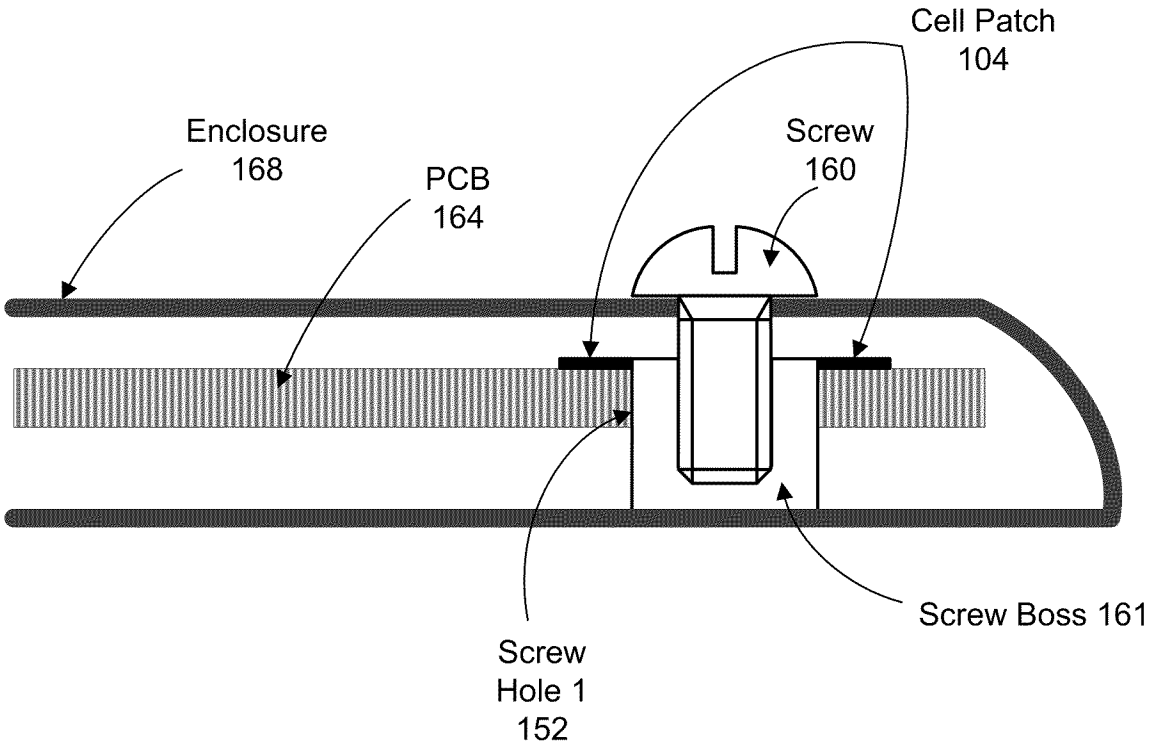
FIG. 1C shows a side view near the mechanical connection unit having a screw and a screw boss.

Two screw holes 1 (152) and 2 (156) are provided with the PCB 164 in the present example. The cell patch 104 is shaped to form an extended portion to surround the screw hole 1 (152), in which a screw 160 made of a metal or an electrically conductive material is inserted to mechanically connect the PCB 164 to the enclosure 168. Instead of using a screw only, a screw boss can be added for connecting two or more parts. FIG. 1C shows a side view near the mechanical connection unit having the screw 160 and the screw boss 161. In this example, the mechanical connection unit mechanically connects the PCB 164 to the top and bottom portions of the enclosure 168. In this configuration, the screw 160 electrically contacts the screw boss 161, which electrically contacts the plated inner wall of the screw hole 1 (152) made in the PCB 164. Thus, the screw 160, the screw boss 161 and the cell patch 104 are electrically coupled and collectively provide a continuous electrically conductive part. As a result, the area and volume of the cell patch is effectively increased due to the attachment of the mechanical connection unit, e.g., the screw 160 and the screw boss 161, thereby improving the antenna efficiency. The top part of the screw can be covered by an electrically insulating material, e.g., a rubber filling, a plastic case, or other means, to prevent user interferences with the screw. Attaching such a conductive mechanical connection unit can modify the current distribution associated with the antenna, in particular in the direction vertical to the printed antenna surface. The radiation patterns and polarizations can thus be adjusted by changing the location and/or dimensions of the mechanical connection unit, which can also facilitate the frequency tuning and impedance matching.

Figure 2:
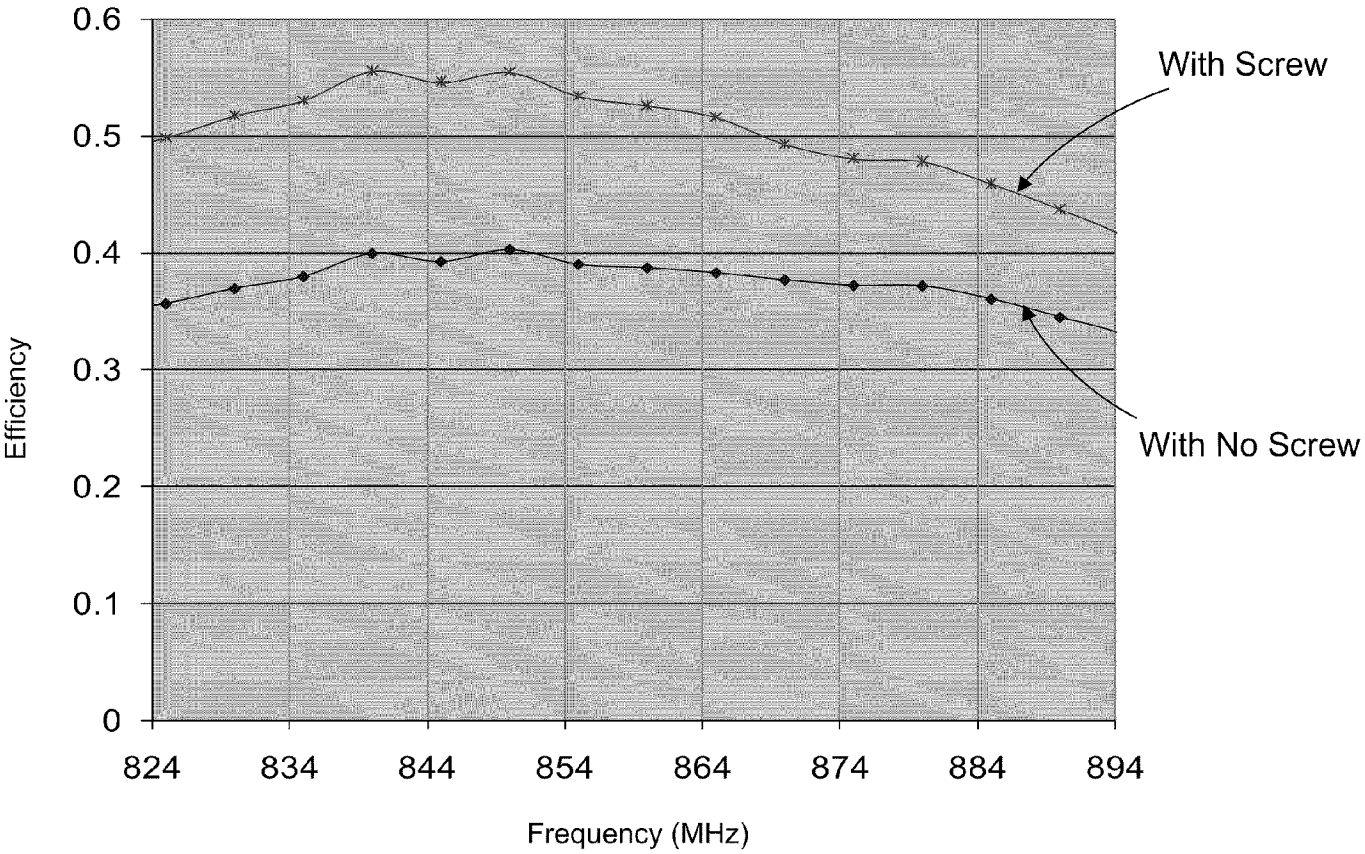
FIG. 2 shows measured efficiency results for the configurations with and without the screw.

FIG. 2 shows measured efficiency results for two MTM antenna devices based on the same MTM antenna design with and without the screw. The measured data indicate that the antenna efficiency for the design with the screw is improved over that of the same antenna design without the screw. This is because the radiating area and volume are increased by attaching the mechanical part to the cell patch 104.

Figure 3:
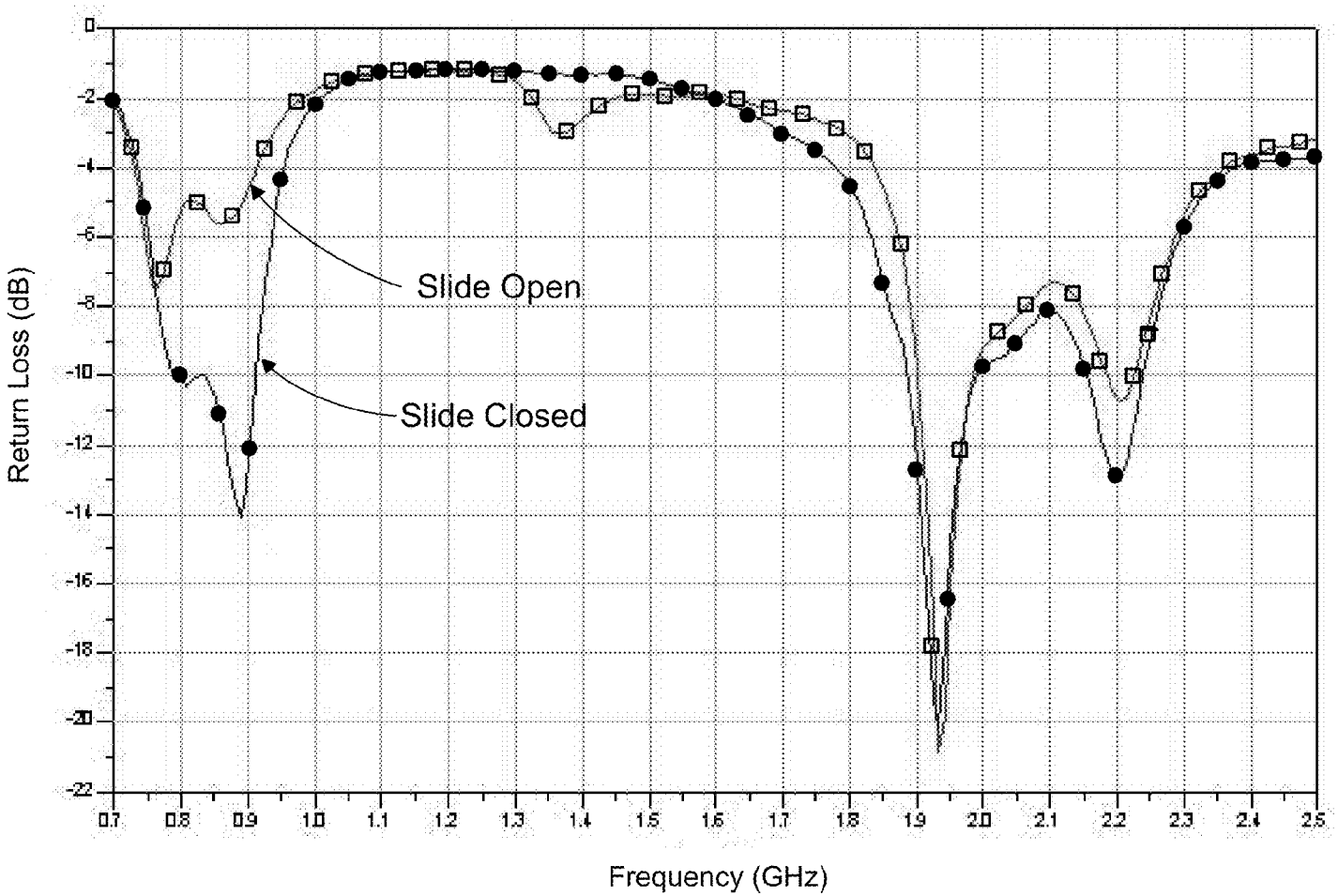
FIG. 3 shows measured return loss results for a cell phone application with the configurations of slide open and slide closed.

FIG. 3 shows measured return loss results when the present MTM antenna design with the screw is implemented for a cell phone application. The results indicate that multiple resonances covering the cellular and PCS/DCS bands are obtained due to the CRLH metamaterial structure of the antenna for both configurations of slide open and slide closed.

Figure 4A:
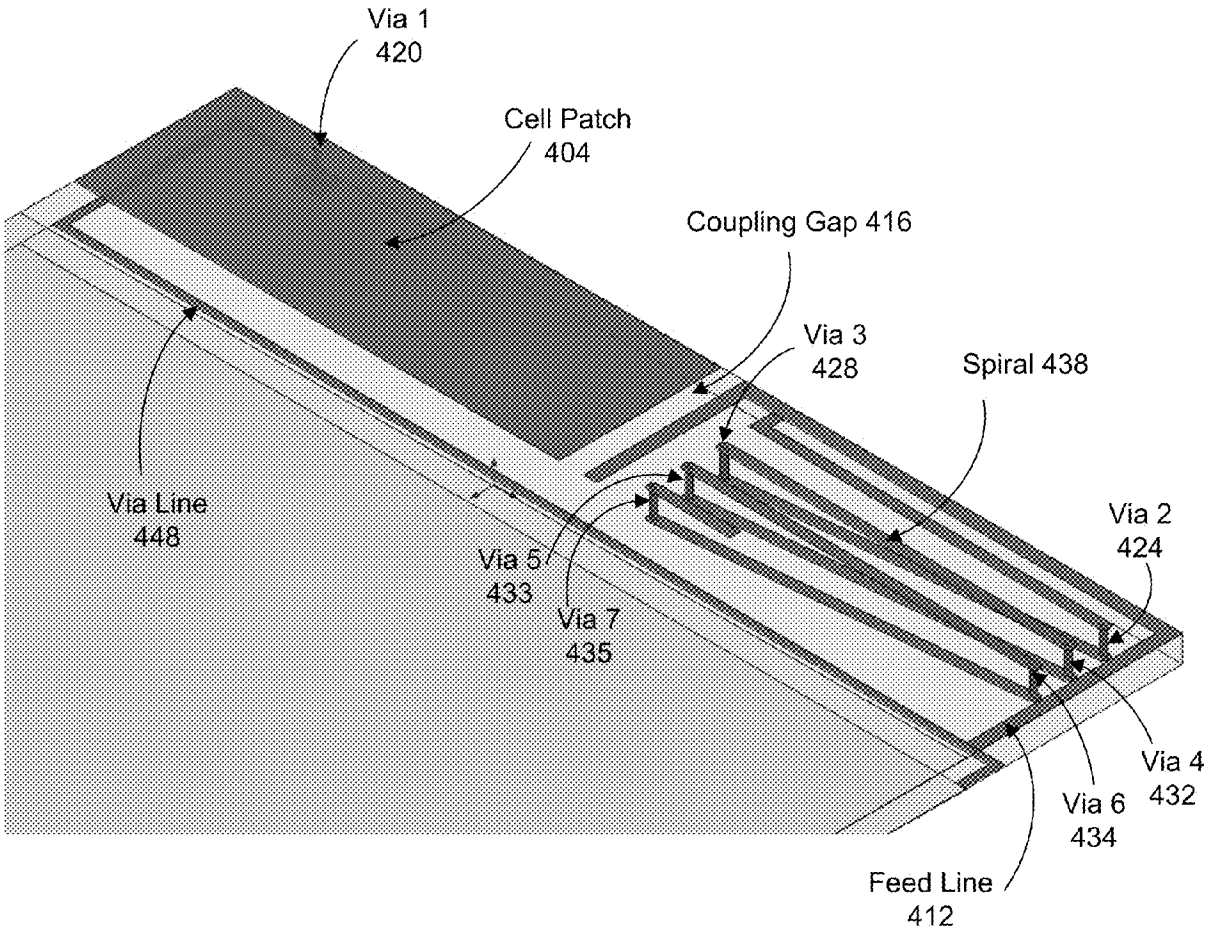
FIG. 4A shows the 3D view of an exemplary MTM antenna structure having a vertical spiral attached to the feed line, similar to the structure shown in FIGS. 1A and 1B.
Figure 4B:
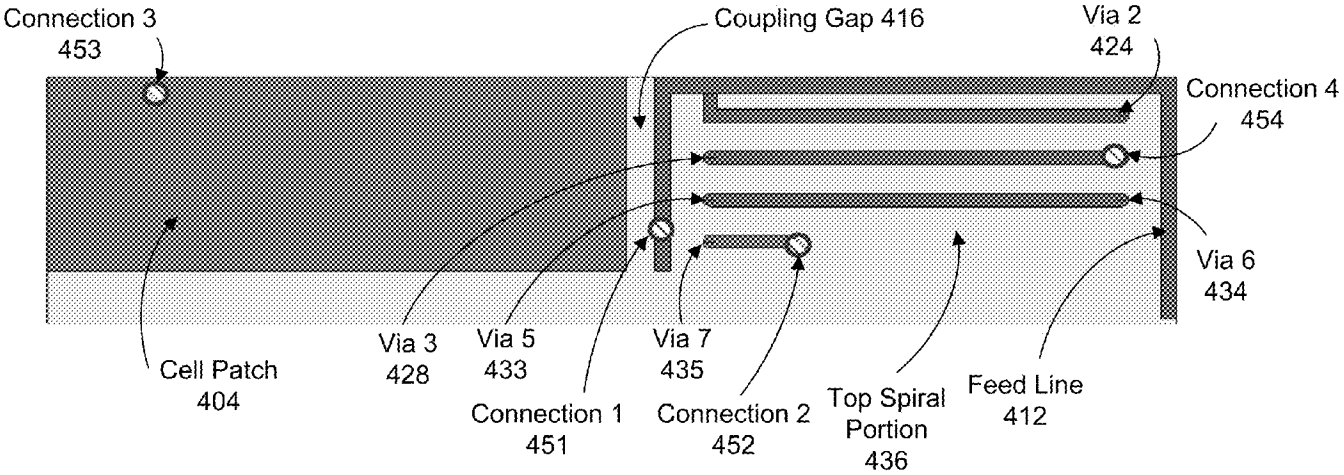
FIGS. 4B and 4C show the top view of the top layer and the top view of the bottom layer of the MTM antenna structure shown in FIG. 4A, respectively, with exemplary locations of the mechanical connection unit.
Figure 4C:
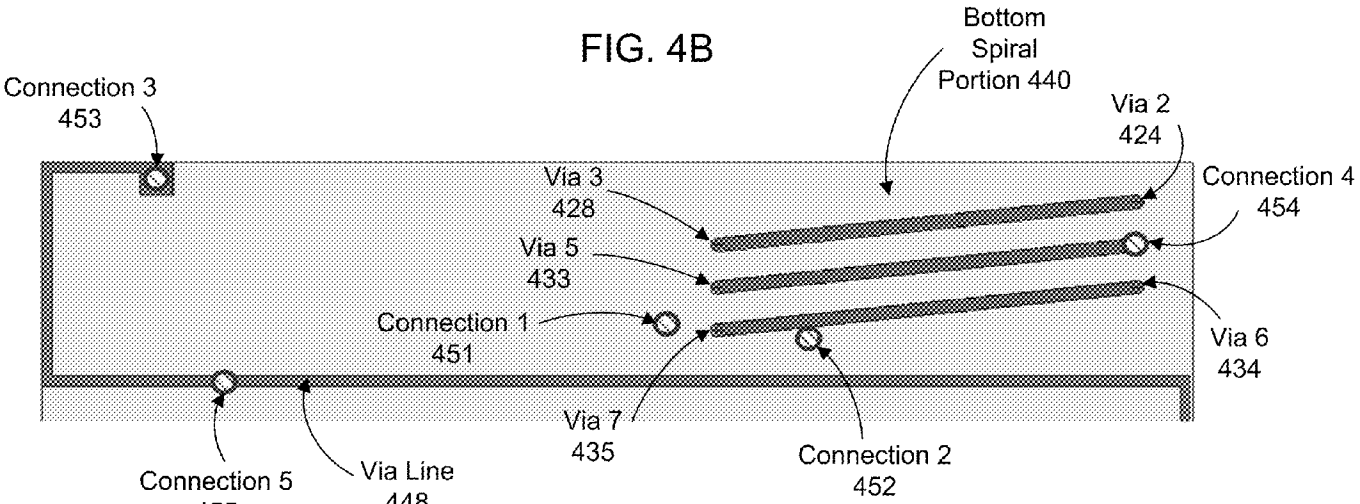

A mechanical connection unit can be used at other locations of the MTM antenna structure not only to provide a mechanical connection but also to increase the area and/or volume of a conductive part through the electrical contact. FIG. 4A shows an example of the MTM antenna structure having a vertical spiral attached to the feed line. FIGS. 4B and 4C show exemplary locations of a mechanical connection unit that provides a mechanical connection as well as a conductive extension for the MTM antenna.

FIG. 4A shows the 3D view of the exemplary MTM antenna structure, which is similar to the structure shown in FIGS. 1A and 1B, except that the cell patch 404 has a rectangular shape instead of the irregular polygonal shape of the cell patch 104; the feed line 412 and the via line 448 have line patterns simpler than the feed line 112 and the via line 148; and the spiral 438 has the top spiral portion 436 and the bottom spiral portion 440, which have more discrete segments, and more vias 2 (424), 3 (428), 4 (432), 5 (433), 6 (434) and 7 (435) with more turns than the spiral in FIGS. 1A and 1B. FIGS. 4B and 4C show the top view of the top layer and the top view of the bottom layer of the MTM antenna structure shown in FIG. 4A, respectively, with the exemplary locations of the mechanical connection unit indicated by connection 1 (451), connection 2 (452), connection 3 (453), connection 4 (454), and connection 5 (455).

The connection 1 (451) is located at the distal end portion of the feed line 412, which is capacitively coupled to the cell patch 404 over the coupling gap 416. As mentioned earlier, the distal end portion of the feed line 412 can be modified to form a launch pad to modify the capacitive coupling. In such a configuration, the connection 1 (451) can be viewed to be located at the launch pad, which is the modified distal end portion of the feed line 412. A conductive mechanical connection unit positioned at the connection 1 (451) can effectively increase the volume and/or area of the launch pad (or the distal end portion of the feed line 412), thereby changing the capacitive coupling that primarily determines the left-handed series capacitance (CL). The RH series inductance (LR) can also be affected by the shape and dimensions of the mechanical connection unit attached to the launch pad (or the distal end portion of the feed line 412). Frequency tuning and impedance matching can thus be optimized by using a proper configuration of the mechanical connection unit at the connection 1 (451).

The connection 2 (452) is located at the end portion of the spiral 438, effectively increasing its length. This longer spiral can contribute to shifting the RH monopole resonance toward the lower frequency region.

The connection 3 (453) is used in place of the via 1 (420) that connects the cell patch 404 in the top layer and the via line 448 in the bottom layer. The mechanical connection unit at the connection 3 (453) can thus eliminate the need for fabricating the via 1 (420) in the PCB, and at the same time perform the mechanical function of connecting the PCB and the enclosure. In addition, the shape and dimensions of the mechanical connection unit at the connection 3 (453) can affect the LH shunt inductance LL. Frequency tuning and impedance matching can thus be optimized by using a proper configuration of the mechanical connection unit used in place of the via originally connecting the cell patch 404 and the via line 448.

The connection 4 (454) is used in place of the via 4 (432) that connects one segment of the top spiral portion 436 in the top layer and another segment of the bottom spiral portion 440 in the bottom layer. When the mechanical connection unit is used in place of a via used in the spiral 438, the shape and dimensions of the mechanical connection unit can affect the RH monopole resonance. For the vertical spiral as shown in FIGS. 4A-4B, more than one via can be replaced with such mechanical parts.

The connection 5 (455) is located at one portion of the via line 448. The mechanical connection unit at the connection 5 (455) can effectively increase the volume, area and length of the via line that affects the LH shunt inductance LL. Frequency tuning and impedance matching can thus be optimized by use of a proper configuration of the mechanical connection unit with the via line 448.

The mechanical connection unit that provides a mechanical connection as well as a conductive extension for a conductive part in the MTM antenna, as exemplified above, can be used in multiple locations in an MTM antenna. For example, the connection 1 and the connection 3 can be used for better antenna performance by optimizing the shape and dimensions of the two mechanical connection units. The similar mechanical implementation can be made in a wide variety of MTM antennas mentioned earlier, such as a Single-Layer Metallization (SLM) MTM antenna, a Two-Layer Metallization Via-Less (TLM-VL) MTM antenna structure, a multilayer MTM antenna structure with at least one via. For multi-substrate structures, the mechanical connection unit can mechanically connect one of the substrates to another substrate or substrates, to the enclosure, to some of the substrates and the enclosure, or to all of the substrates and the enclosure. In the MTM antenna having multiple cell patches, one or more mechanical connection units can be attached respectively to one or more cell patches to increase the antenna efficiency. A vertical spiral shape is used in the above example for a conductive line attached to the feed line to induce the RH monopole mode. However, a variety of different geometrical shapes and dimensions, such as rectangular, irregular, zigzag, planar spiral, meander, or combinations of different shapes, can be used for the similar purpose. Accordingly, the mechanical connection unit can be implemented with any of these shapes.

The above described techniques for using one or more mechanical connection units made of electrically conductive materials to provide both mechanical engagement and electrical conduction for MTM antenna devices can be implemented in various MTM antenna structures, such as MTM structures described in this document and MTM structures described in references that are incorporated by reference as part of this document.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. Variations and enhancements of the disclosed implementations and other implementations can be made based on what is disclosed and illustrated.

What is claimed is:

1. A metamaterial antenna device comprising:

a substrate structure;

one or more metallization layers supported by the substrate structure and structured to include:

a ground electrode formed in one of the one or more metallization and a plurality of electrically conductive parts formed in at least one of the one or more metallization layers, the plurality of electrically conductive parts including:

a cell patch;

a via line coupling the cell patch to the ground electrode;

a feed line comprising:

a conductive line attachment comprising at least one of a meander line shape, a spiral shape, or a zigzag shape;

a distal end close to and capacitively coupled to the cell patch; and a proximal end coupled to a feed port for directing the an antenna signal to and from the cell patch; and one or more connecting units respectively mechanically engaging at least part of the substrate structure to a device enclosure and respectively electrically coupled to at least one of the plurality of electrically conductive parts, wherein the plurality of electrically conductive parts, the one or more connecting units, and at least part of the substrate structure are configured to form a composite left and right handed (CRLH) metamaterial antenna structure that exhibits a plurality of frequency resonances associated with the antenna signal.

2. The antenna device as in claim 1, wherein the one or more connecting units include a first connecting unit which electrically couples to the cell patch.

3. The antenna device as in claim 1, wherein the one or more connecting units include a first connecting unit which electrically couples to the distal end portion of the feed line.

4. The antenna device as in claim 1, wherein the distal end portion of the feed line is modified to form a launch pad to modify capacitive coupling.

5. The antenna device as in claim 4, wherein the one or more connecting units include a first connecting unit which electrically couples to the launch pad.

6. The antenna device as in claim 1, wherein the one or more connecting units include a first connecting unit which electrically couples to the via line.

7. The antenna device as in claim 1, wherein the one or more connecting units include a first connecting unit which electrically couples to the conductive line attachment.

8. The antenna device as in claim 1, wherein the conductive line attachment includes one or more of a vertical spiral shape or a planar spiral shape.

9. The antenna device as in claim 8, wherein the conductive line attachment includes a plurality of first segments in a first metallization layer, a plurality of second segments in a second metallization layer, and a plurality of vias formed between the first and second metallization layers and connecting the first and second segments at multiple locations, wherein the first segments, the second segments, and the vias are configured to form the vertical spiral shape.

10. The antenna device as in claim 8, wherein the conductive line attachment includes a plurality of first segments in a first metallization layer, a plurality of second segments in a second metallization layer, one of the one or more connecting units electrically coupling one of the first segments and one of the second segments at one location, and a plurality of vias formed between the first and second metallization layers and connecting the first and second segments at multiple locations other than the one location, and wherein the first segments, the second segments, the one of the one or more connecting units, and the vias are configured to form the vertical spiral shape.

11. The antenna device as in claim 8, wherein the conductive line attachment includes a plurality of first segments in a first metallization layer, a plurality of second segments in a second metallization layer, first one of the one or more connecting units electrically coupling one of the first segments and one of the second segments at a first location, second one of the one or more connecting units electrically coupling one of the first segments and one of the second segments at a second location, and a plurality of vias formed between the first and second metallization layers and connecting the first and second segments at multiple locations other than the first and second locations, and wherein the first segments, the second segments, the first one of the one or more connecting units, the second one of the one or more connecting units, and the vias are configured to form the vertical spiral shape.

12. The antenna of claim 1, wherein the conductive line attachment comprises a meander line shape.

13. The antenna of claim 1, wherein the conductive line attachment comprises a zigzag shape.

14. The antenna device as in claim 1, wherein the cell patch is formed in a first metallization layer; and the via line is formed in a second metallization layer and coupled to the ground electrode; and a via is formed between the first metallization layer and the second metallization layer and coupling the cell patch and the via line.

15. The antenna device as in claim 1, wherein the cell patch is formed in a first metallization layer; the via line is formed in a second metallization layer and coupled to the ground electrode; and wherein the one or more connecting units includes a first connecting unit which electrically couples the cell patch and the via line.

16. The antennas device as in claim 1, wherein the one or more connecting units include a first connecting unit which comprises:

a screw, made of an electrically conductive screw material, mechanically engaged with the device enclosure; and a screw boss, made of an electrically conductive screw boss material, mechanically engaging the screw, the device enclosure and the substrate structure and electrically coupling to the screw and to the at least one of the plurality of conductive parts.

17. A metamaterial antenna device comprising:

a substrate structure;

one or more metallization layers supported by the substrate structure and structured to include:

a ground electrode formed in one of the one or more metallization and a plurality of electrically conductive parts formed in at least one of the one or more metallization layers, the plurality of electrically conductive parts including:

a plurality of cell patches; and a plurality of via lines coupling the plurality of cell patches respectively to the ground electrode;

wherein the feed line includes a distal end close to and capacitively coupled to one or more of the plurality of cell patches, and a proximal end coupled to a feed port for directing the an antenna signal to and from the cell patch; and one or more connecting units respectively mechanically engaging at least part of the substrate structure to a device enclosure and respectively electrically coupled to at least one of the plurality of electrically conductive parts, wherein the plurality of electrically conductive parts, the one or more connecting units, and at least part of the substrate structure are configured to form a composite left and right handed (CRLH) metamaterial antenna structure that exhibits a plurality of frequency resonances associated with the antenna signal.

18. The antenna device as in claim 17, wherein the one or more connecting units include a first connecting unit coupled to one of the cell patches, and a second connecting unit coupled to another one of the cell patches.

19. The antenna device as in claim 17, wherein the one or more connecting units include a first connecting unit coupled to one of the via lines, and a second connecting unit coupled to another one of the via lines.

20. A method for providing a metamaterial device, comprising:

forming a substrate structure;

forming one or more metallization layers supported by the substrate structure, including:

forming a ground electrode in one of the one or more metallization and forming a plurality of electrically conductive parts in at least one of the one or more metallization layers, the plurality of electrically conductive parts including: a cell patch; a via line coupling the cell patch to the ground electrode; a feed line comprising:

a conductive line attachment comprising at least one of a meander line shape, a spiral shape, or a zigzag shape;

a distal end close to and capacitively coupled to the cell patch; and a proximal end coupled to a feed port for directing the antenna signal to and from the cell patch; and mechanically engaging at least part of the substrate structure to a device enclosure using one or more connecting units respectively electrically coupled to at least one of the plurality of electrically conductive parts, wherein the plurality of electrically conductive parts, the one or more connecting units, and at least part of the substrate structure are configured to provide a composite left and right handed (CRLH) metamaterial antenna structure that exhibits a plurality of frequency resonances associated with an antenna signal.

21. The method of claim 20, wherein forming the conductive line attachment includes forming one or more of a vertical spiral shape or a planar spiral shape.

22. The method of claim 21, wherein forming the conductive line attachment includes:

forming a plurality of first segments in a first metallization layer;

a plurality of second segments in a second metallization layer;

electrically coupling one of the first segments and one of the second segments at one location using one of the one or more connecting units;

forming a plurality of vias between the first and second metallization layers connecting the first and second segments at multiple locations other than the one location, wherein the first segments, the second segments, the one of the one or more connecting units, and the vias are configured to form the vertical spiral shape.

* * * * *

UNITED STATES PATENT AND TRADEMARK OFFICE

CERTIFICATE OF CORRECTION

PATENT NO. : 8,698,700 B2
APPLICATION NO. : 12/604306
DATED : April 15, 2014
INVENTOR(S) : Pathak et al.

It is certified that error appears in the above-identified patent and that said Letters Patent is hereby corrected as shown below:

In the Claims

In column 9, line 18-19, in Claim 1, delete “metallization and” and insert --metallization layers; and--, therefor In column 9, line 31, in Claim 1, after “directing”, delete “the”, therefor In column 11, line 5-6, in Claim 17, delete “metallization and” and insert --metallization layers; and--, therefor In column 11, line 16, in Claim 17, after “directing”, delete “the”, therefor In column 12, line 35, in Claim 22, after “units;”, insert --and--, therefor Signed and Sealed this
Second Day of December, 2014

Michelle K. Lee

Michelle K. Lee
*Deputy Director of the United States Patent and Trademark Office*